US005190718A

United States Patent [19]

Buffard et al.

[11] Patent Number: 5,190,718

[45] Date of Patent: Mar. 2, 1993

[54] MACHINE FOR THERMO-MECHANICAL TREATMENT OF PARTS MADE OF MEMORY ALLOYS

[75] Inventors: Laurent Buffard, Saint Cyr Sur Mer; Michel Raymond, Laciotat; Léo Vincent, Saint Germain Au Mont d'Or; Renee-Paule Girones, Cadenet; Andre Barrier, Lozanne, all of France

[73] Assignee: Imago, Ajaccio, France

[21] Appl. No.: 732,108

[22] Filed: Jul. 18, 1991

[30] Foreign Application Priority Data

Jul. 20, 1990 [FR] France ..... 90 09715

[51] Int. Cl.[5] ..... B21K 29/00

[52] U.S. Cl. ..... 266/96; 266/252; 266/262

[58] Field of Search ..... 266/96, 262, 249, 274, 266/252; 148/402, 2

[56] References Cited

U.S. PATENT DOCUMENTS

| | | | |
|---|---|---|---|
| 2,465,511 | 3/1949 | Campion, Sr. | 266/262 |
| 4,245,819 | 1/1981 | Bache et al. | 266/96 |
| 4,753,689 | 6/1988 | Rizzo et al. | 148/402 |
| 4,757,978 | 7/1988 | Hodgson | 266/274 |

FOREIGN PATENT DOCUMENTS

| | | |
|---|---|---|
| 0161952A2 | 11/1985 | European Pat. Off. . |
| 2410045 | 6/1979 | France . |

*Primary Examiner*—Scott Kastler
*Attorney, Agent, or Firm*—Oliff & Berridge

[57] ABSTRACT

A machine for the thermo-mechanical treatment of parts made of memory alloys contains: a thermally insulated chamber connected to a source of gaseous fluid and a support, capable of being introduced into a chamber, for carrying a plurality of crowns superimposed on one another. The parts made of memory alloy are placed between the crowns where the gaseous fluid passes through. Tension is applied to the crown in a controlled operating cycle.

21 Claims, 2 Drawing Sheets

MACHINE FOR THERMO-MECHANICAL TREATMENT OF PARTS MADE OF MEMORY ALLOYS

The subject of the present invention is a mach for thermo-mechanical treatment of parts made of memory alloys.

BACKGROUND OF THE INVENTION

The thermo-mechanical treatment, called "education", creates a memory effect in two directions in a memory alloy. This treatment allows memorization of a certain shape at low temperatures. This shape is exhibited by the alloy in its martensitic phase.

Obtaining this bidirectional deformation effect is essential to many industrial applications. To "educate" a part made of a memory alloy, a constant displacement or constant force is imposed on the part at certain temperatures, called the high and low temperatures. A basic cycle is then performed consisting of maintaining a high temperature associated with a displacement or a force, then changing to a low temperature that is also associated with a displacement or a force. The memory materials are educated in a rather empirical fashion so that it often takes tens or thousands of cycles to educate a part. In addition, the education conditions must be very precise to ensure reproducibility of the characteristics from one part to the next.

SUMMARY OF THE INVENTION

A goal of the invention is to provide a thermo-mechanical machine which can simultaneously educate a large number of parts made of a memory alloy in fewer cycles, and to obtain complete reproducibility of parts treated in the course of various operations.

To this end, the machine comprises the following:

- a thermally insulated chamber connected to a source of a heat-conducting gaseous fluid which is successively hot and cold;
- a support which can be introduced into the chamber and supports several crowns superimposed on one another between which the parts made of memory alloy are placed, said crowns being arranged to allow gaseous fluid to pass through;
- a device for applying tension onto the crowns, perpendicularly thereto, and
- a control device for controlling the operating cycle.

Advantageously, each crown comprises near its outer edge, and regularly distributed angularly, axial holes, for slidably engaging a rod, likewise engaged in an adjacent crown. Each rod serves to guide one part made of memory alloy, such as a spring, which abuts at its ends two adjacent crowns. The crowns are thus separated from each other by parts made of memory alloy. One end of the stack of crowns contacts the support capable of being inserted into the chamber, while the other end is subjected to the action of the device for applying tension.

According to another feature of the invention, the device for applying tension comprises a rod traversing the upper wall of the chamber axially and a seal at the center of the chamber. One end of the rod is located outside the chamber and is associated with means for axial displacement. The other end of the rod, located inside the chamber, is provided with the following:

- a bell-shaped part comprising a plate perpendicular to the rod, whose outer edge is extended by a tubular extension having a diameter greater than that of the crowns supporting the parts to be treated and of a height such that, in the upper position, it allows lateral insertion and removal of the crowns, and, in the lower position, its lower edge is located essentially at the level of the lowest crown; and
- a generally cone shaped part centered on the axis, whose apex points downward and whose base has a diameter that essentially corresponds to the diameter of the openings in the crowns, said cone-shaped part being surrounded by a perforated tube having a generally frustoconical shape with the small base facing downward, designed to enter the central openings of the crowns.

This machine is significant in that the treatment of several hundreds of parts in the course of a single operation is possible, with education being completed in less than ten cycles. This is made possible by the design of the machine, especially the supporting plates in the shape of crowns which allow central input of the heat-conducting fluid which regularly comes in contact with all the parts.

The design of the lower end of the device for applying tension, forces heat-conducting fluid (e.g., air) to come into contact with the parts being processed, the air being supplied at the center of the chamber, passing through the tube which is perforated to diffuse radially outward. The radial movement of air is promoted by the shape of the central ferrule, with the air descending again inside the tubular bell-shaped wall, before rising again in the chamber in the annular space between the outer face of this tubular wall and the wall of the chamber itself. This precise control of the movement of the heat-conducting fluid is accompanied by the thermal insulation of the chamber and the possibility of very rapidly changing the temperature of the heat-conducting fluid (e.g., by heating using resistors, or by cooling through the evaporation of a cryogenic fluid). It is therefore possible to maintain the homogeneity of the temperature primarily by reducing the influence of the exothermal and endothermal effects (linked to phase transformations) and, consequently, to reduce the number of education cycles, while obtaining outstanding reproducibility in the characteristics of the parts treated.

BRIEF DESCRIPTION OF THE DRAWINGS

In any event, the invention will be more completely understood by reading the description which follows with reference to the attached schematic diagrams showing as a nonlimitative example one embodiment of this machine designed for treatment of parts made of memory alloy, namely springs.

DETAILED DESCRIPTION OF PREFERRED EMBODIMENTS

Figure 1:
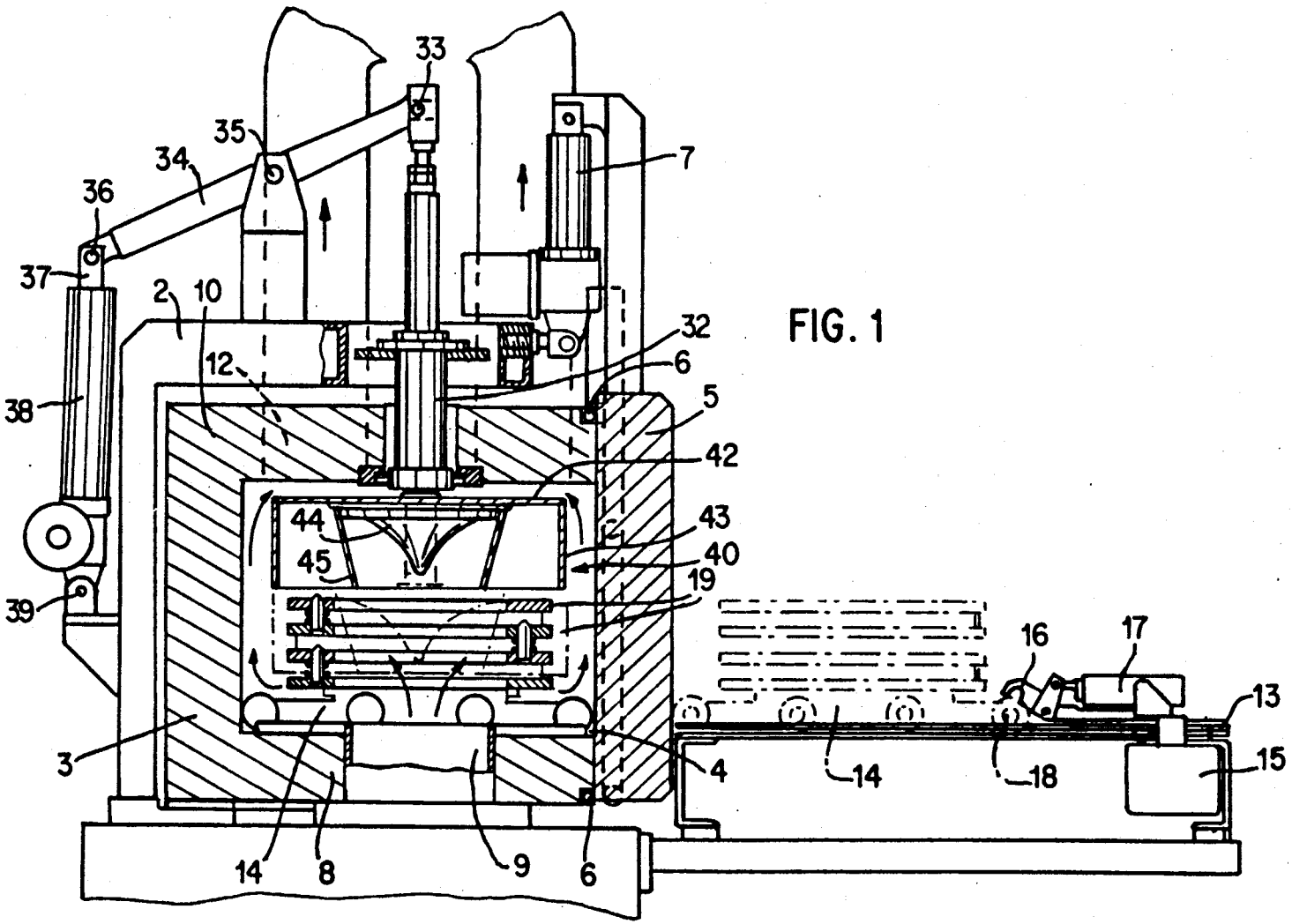
FIG. 1 is a longitudinal section through this machine.

The machine shown in FIG. 1 comprises a base 2 inside which a thermally insulated chamber 3 is located. The chamber 3 has a lateral opening 4 designed to be closed by a door 5. The door 5 is sealed by gaskets 6, and is actuated by a jack 7. Guide means are provided for door 5 such that to pass from its closed position shown in FIG. 1 to its open position, the door is first opened outward to decompress gaskets 6 before being displaced vertically upward.

Lower wall 8 of chamber 3 has an opening 9 for adding heat conducting fluid, said opening preferably being made in the middle of wall 8. In its upper wall 10, chamber 3 has a plurality of openings 12 designed for evacuation of the heat-conducting fluid. These openings 12, arranged in symmetric fashion, are preferably eccentric relative to the vertical axis of chamber 3.

Outside the chamber, horizontal tracks 13 are provided, extending as far as door 5. These tracks serve to guide two carriages, a first carriage 14 which supports the crowns and a second motorized carriage 15. The movement of carriage 15 is preferably produced by a rack and pinion system. Carriage 15 is equipped with a hook 16 that pivots around a horizontal axis, and is capable of pivoting under the influence of a jack 17 so that it engages or disengages from an axle 18 belonging to carriage 14. It is therefore possible to displace carriage 14 to move it into or out of chamber 3 by coupling it to motorized carriage 15. As shown in FIG. 1, the central part of the first carriage 14 is largely perforated to allow passage of the heat-conducting fluid when the carriage is inside chamber 3. In the embodiment shown in FIG. 1, each carriage 14 is designed to hold four crowns 19. The four crowns 19 are arranged in parallel and coaxial fashion in order to delimit three intervals which serve to receive springs 20 made of memory alloy. Each crown 19 comprises a central opening 22 with a large diameter relative to the diameter of the crown, and an exterior part 23 having holes 24, each serving to receive a rod 25 surrounded by a spring 20. Rods 25 (FIG. 2) can slide relative to holes 24 while the crowns move toward or away from one another. Holes 24 are distributed at regular angular intervals around the crown and can be on the order of 100 in number. Each crown comprises a part 26 located radially inward in which holes 27 allow the axial guide fingers 28 of the crowns to pass one another, as well as recesses 29 to reduce thermal inertia.

The device for applying tension to the springs (FIG. 1) comprises a rod 32 which passes through upper wall 10 of chamber 3 and is located along the axis of the chamber. The upper end of the rod 32 is articulated around a horizontal axis 33 at one end of lever 34. The central part of lever 34 is articulated around a horizontal axis 35 on base 2 and the other end is articulated around an axis 36 parallel to the above axes on the end of rod 37 of a jack 38. The body of this jack is itself mounted so that it is articulated around a horizontal axis 39 on the base. The movements of the jack are translated into a vertical displacement of rod 32 upward or downward, depending on the direction of operation of the jack.

At its lower end, rod 32 is provided with a bell-shaped part 40 which has a surface 42 perpendicular to the axis of the rod. The outer edge of surface 42 has a tubular extension 43. The extension 43 has a diameter larger than that of the crowns supporting springs 20. When the rod is in its upper position it is possible, as shown by the solid lines in FIG. 1, to laterally insert and remove the crown-carrying carriage. When the rod is in its lower position (shown by the dot-dashed lines in FIG. 1 and in solid lines on the right-hand side of FIG. 2), its lower edge is located essentially at the lowest crown so as to cover completely the volume containing the springs 20 to be educated.

In the middle part of part 40, a shaped nipple 44 points downward with a generally frustoconical shape and with the apex pointing downward, the wall of this nipple being a body of revolution, curved toward the interior. The diameter of the base of this nipple corresponds substantially to the openings in crowns 19 so as to allow accommodation in central openings 22 of said crowns. Shaped nipple 44 is itself surrounded by a perforated tubular part 45, having a generally frustoconical shape, and whose small base, facing downward, is designed to enter the central openings 22 of the crowns 19 in such a manner that in the position in which force is applied, the small base of part 45 is located below the crown at the lower level.

Figure 2:
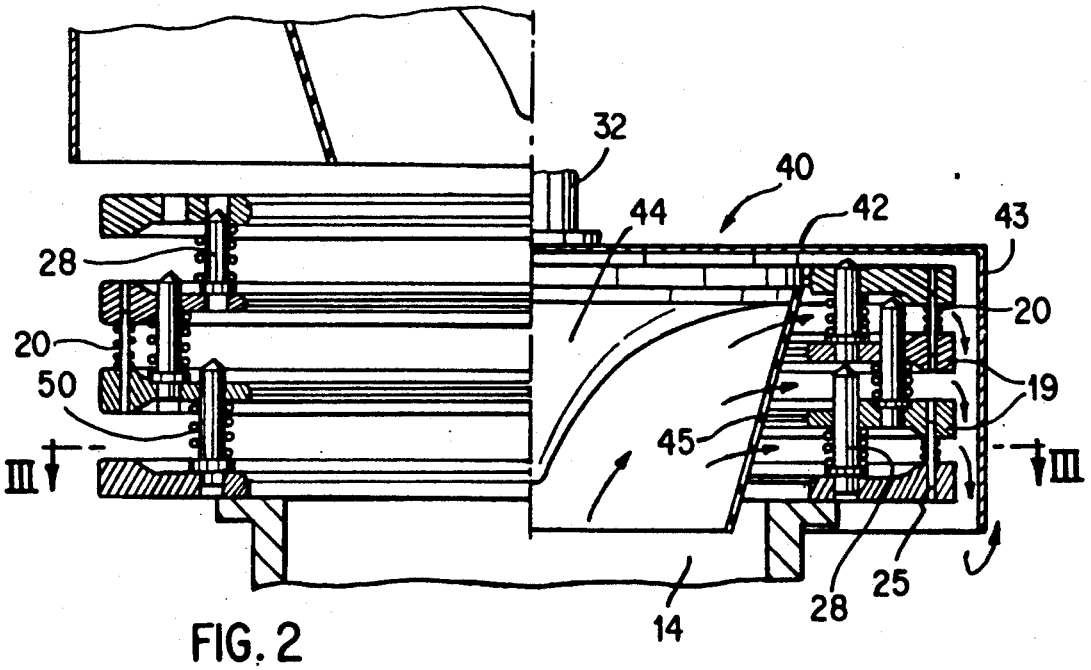
FIG. 2 is a cross section on an enlarged scale of the stack of crowns supporting the springs, and of the lower end of the device for applying tension in two extreme positions, at the right and left in the drawing, respectively.
Figure 3:
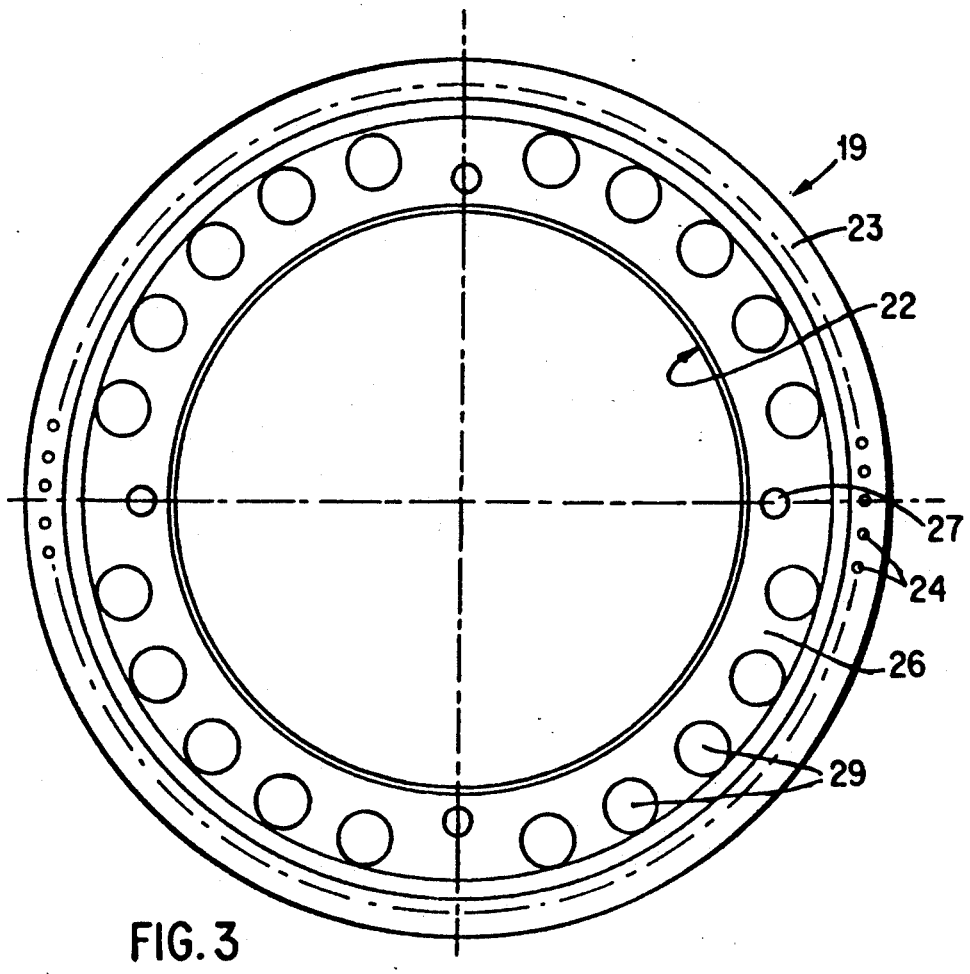
FIG. 3 is a cross section along line III—III in FIG. 2, showing a crown holding springs.

When rod 32 moves downward, plate 42 abuts upper crown 19 and exerts a vertical downward pressure on it which ensures compression of springs 20 until the plate and nipple are in the position shown by the dot-dashed lines in FIG. 1 or on the right-hand side of FIG. 2. It follows from this structure that in the position in which the springs are compressed, the heat-conducting fluid enters through opening 9 into the space within part 45, and is then diverted radially outward by shaped nipple 44, passes through perforated part 45, flows along springs 20, then flows downward along the inside face of wall 43, and then flows upward into the annular space provided between wall 43 and the wall of the chamber. This structure makes it possible fully to control the path of the heat-conducting fluid and to permit rapid transition from one temperature to another using a smaller volume of fluid.

The machine may be equipped with a control device to control the following different phases in succession:

- opening of door 5, advance of the crown-carrying carriage 14 and motorized carriage 15 until the former enters chamber 3;
- uncoupling of the two carriages and return of the motorized carriage to its starting position;
- closing of door 5;
- applying the high temperature and holding it for a fixed time interval;
- lowering the movable assembly from the tension-applying device corresponding to compression of the springs as shown on the right-hand side of FIG. 2;
- application of the low temperature and holding at this low temperature for a specified period of time with the springs in the compressed position;
- return of the movable assembly and raising the crowns using counter springs 50 surrounding guide fingers 28 and repeating the cycle a specified number of times;
- changing the internal temperature of the chamber to that of the surrounding atmosphere;
- opening door 5;
- advancing motorized carriage 15 and coupling it to crown-carrying carriage 14;
- returning both carriages 14 and 15 to their starting positions, with carriage 15 pulling carriage 14; and
- closing door 5.

According to another embodiment, the control device controls the following phases in order:

- opening of door 5;
- advance of crown-carrying carriage 14 and of motorized carriage 15 until the former enters the chamber;

uncoupling of the two carriages and return of motorized carriage 15 to its starting position;
closing the door;
applying a high temperature and holding it for a fixed period of time;
lowering movable assembly 32, 40–45 of the device for applying tension;
applying a low temperature and holding it for a fixed period of time;
exposure to high temperature, with movable assembly 32, 40–45 still lowered and hence under tension;
repetition of a cooling and heating cycle for a programmed number of times;
exposure to ambient temperature;
opening of door 5;
advance of motorized carriage 15 and coupling with crown-carrying carriage 14;
return of the two carriages to the starting position;
closure of door 5.

According to another embodiment, the control device is designed to control the above phases, in order, for tens of thousands of cycles, and to simultaneously permit the fatigue behavior of several hundreds of springs with a memory effect to be studied.

As can be seen from the above, the invention provides a considerable improvement over existing technology by providing a machine with a compact design which makes it possible simultaneously to educate a large number of parts made of memory alloys, during a very limited number of deformation cycles, while providing outstanding results in the reproducibility of parts processed in the course of various operations.

It goes without saying that the invention is not limited to the embodiments described above; on the contrary, the invention includes all variations on the disclosed embodiments. In particular, the number of crowns could be different, the means of operating rod 32 could be different, and the introduction of crowns into the chamber could be accomplished by other means without departing from the scope of the invention.

What is claimed is:

1. A machine for thermo-mechanical treatment of parts made of memory alloys, comprising:
a thermally insulated chamber connected to a source of heat-conducting fluid;
a support, capable of being introduced into said chamber, supporting several crowns superimposed on one another and containing said parts, the crowns being arranged to permit passage of the gaseous fluid, wherein each of said crowns has a central opening and regularly angularly distributed axial holes for engaging a slidable rod, said slidable rod serving to guide said parts; and
a tension applicator for applying tension to the crowns.

2. The machine of claim 1, further comprising a control device for controlling an operating cycle of the machine.

3. The machine of claim 1, wherein said parts abut two adjacent crowns; said crowns being arranged in a stack so that a top crown in the stack contacts said support and a lower crown in the stack contacts the tension applicator.

4. The machine of claim 1, wherein each crown has a radially outer portion in which said axial holes are provided for positioning said parts, wherein said outer portion is wider than a radially inner portion.

5. The machine of claim 4, wherein said radially inner portion has axial openings provided for the passage of fingers for axially guiding the crowns relative to one another, and has recesses provided to reduce thermal inertia.

6. The machine of claim 1, wherein said support comprises a first carriage having displacement means for displacement between a position inside the chamber and a position outside the chamber by passing through a sealable opening in the chamber.

7. The machine of claim 6, wherein said displacement means comprises a second carriage which is equipped with coupling means and is guided on a guide track outside the chamber.

8. The machine of claim 7, wherein said second carriage is displaceable by a rack and pinion system.

9. The machine of claim 7, wherein the coupling means said second carriage and said first carriage is a hook articulated on said second carriage and actuated by a jack, wherein said hook is designed to engage with the first carriage.

10. The machine of claim 1, wherein said chamber has a central opening for admitting said heat-conducting fluid and wall openings in an upper wall of said chamber which are eccentric and distributed symmetrically in order to evacuate the heat-conducting fluid.

11. The machine of claim 1, wherein the tension applicator comprises an operating rod which axially traverse an upper wall of the chamber, said rod having a first end located outside the chamber and associated with an axial displacement means and a second end located inside the chamber.

12. The machine of claim 11, wherein said second end comprises a bell-shaped part comprising a plate positioned perpendicular to said operating rod and having a tubular extension, and a generally cone-shaped part having an apex facing downward.

13. The machine of claim 12, wherein said tubular extension has a diameter greater than the diameter of said crowns.

14. The machine of claim 12, wherein when said bell-shaped part is of such a height that in an upper position the crowns may be laterally inserted below said bell-shaped part, and in a lower position, a lower edge of said tubular extension is substantially level with a lowest said crown.

15. The machine of claim 12, wherein said cone-shaped part is surrounded by a perforated tube that has a generally frustoconical shape designed to penetrate the central openings in the crowns.

16. The machine of claim 11, wherein the first end of said operating rod is articulated around a horizontal axis of one end of a lever, said lever is articulated at a central point on a horizontal axis, and the other end of said lever is articulated insert a around an axis parallel to said horizontal axis.

17. The machine of claim 1, comprising temperature-regulating means for regulating the temperature of the heat-conducting fluid.

18. The machine of claim 17, wherein said temperature-regulating means comprises electrical resistors for heating said heat-conducting fluid and vaporizing a cryogenic fluid.

19. The machine claim 2, wherein said control device is programmed to operate the machine in a cycle comprising the following different phases in succession:
opening a door;

advancing a first carriage carrying the crowns and a second carriage coupled to said first carriage from a starting position until the first carriage enters the chamber;

uncoupling said first and second carriages and returning said second carriage to the starting position;

closing the door;

applying a high temperature within said chamber for a predetermined period of time;

lowering said tension applicator to apply tension to said parts;

applying a low temperature within said chamber for a predetermined period of time;

elevating the tension applicator and raising the crowns;

repeating the temperature cycle a programmed number of times;

exposing the chamber to ambient temperature;

opening the door;

advancing said second carriage from the starting position and coupling it to the first carriage;

returning said first and second carriages to their starting positions; and closing door.

20. The machine of claim 2, wherein the control device is programmed to control in sequence the following phases:

opening a door;

advancing a first carriage carrying the crowns from a first starting position and said second carriage from a second starting position until the first carriage enters the chamber;

uncoupling the first and second carriages and returning said second carriage to the second starting position;

closing the door;

applying a high temperature within said chamber for a predetermined period of time;

lowering the tension applicator to apply tension to said parts;

applying a low temperature within said chamber for a predetermined period of time;

applying said high temperature while said tension applicator is maintained in a lowered position;

repeating the cooling and heating cycle a programmed number of times;

exposing the chamber to ambient temperature;

opening the door;

advancing said second carriage and coupling said second carriage to said first carriage;

returning both carriages to their starting positions; and closing the door.

21. The machine according to claim 19, wherein the temperature cycle is repeated tens of thousands of times to permit the fatigue behavior of several hundreds of memory springs to be analyzed.

* * * * *